US006597286B2

(12) United States Patent
Shih et al.

(10) Patent No.: US 6,597,286 B2
(45) Date of Patent: Jul. 22, 2003

(54) HAZARDOUS MATERIAL MONITOR/ CONTROL METHOD AND SYSTEM PROVIDING HAZARDOUS MATERIAL RESPONSE AND CONTROL PROCEDURES INTEGRAL THEREWITH

(75) Inventors: Kun-Pai Shih, Hsin-Chu (TW); Kun-Chi Chang, Hsin-Chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 139 days.

(21) Appl. No.: 09/815,363

(22) Filed: Mar. 22, 2001

(65) Prior Publication Data

US 2002/0135475 A1 Sep. 26, 2002

(51) Int. Cl.[7] ..... G08B 21/00
(52) U.S. Cl. ..... 340/540; 340/632
(58) Field of Search ..... 340/632, 633, 340/634, 540; 73/23.2, 31.01

(56) References Cited

U.S. PATENT DOCUMENTS 4,567,472 A * 1/1986 Shirai et al. ..... 340/525
4,866,594 A 9/1989 David et al. ..... 700/9
5,664,112 A * 9/1997 Sturgeon et al. ..... 705/28
5,969,623 A 10/1999 Fleury et al. ..... 340/632
2002/0084918 A1 * 7/2002 Roach ..... 340/988

* cited by examiner

*Primary Examiner*—Thomas Mullen
(74) *Attorney, Agent, or Firm*—Tung & Associates

(57) ABSTRACT

Within both a method for monitoring and controlling a hazardous material and a system for monitoring and controlling the hazardous material there is provided: (1) a controller; (2) a hazardous material sensor in communication with the controller; and (3) a user interface in communication with the controller. Within both the method and the system, the controller is programmed such that when the hazardous material sensor senses a hazardous material, the user interface provides an output directed towards hazardous material response and control procedures for the hazardous material. The method and the system provide for more efficient emergency response to a hazardous material emergency.

14 Claims, 2 Drawing Sheets

HAZARDOUS MATERIAL RESPONSE AND CONTROL PROCEDURE
HYDROGEN BROMIDE - MSDS NUMBER 027

I. Hazardous Material Properties

1. Toxic Characteristics
Permissible Conc. (TWA): 3 ppm.
Poisonous and toxic. Spicy, hot & irritable smell.
Ingested through aspiration, skin contact and eye contact.
Causes tearing, breathing difficulty, pneumonia & pulmonary edema.

2. Fire/Explosion Characteristics
Not combustible. No fire hazard.

3. Chemical Characteristics
No harmful polymerization. Thermally unstable. Unstable in the presence of bases, oxidants and moisture.

II. Primary Emergency Response Rescue Protocol

1. Emergency Treatment for Rescued Party
Remove exposed party to fresh air. Apply CPR if needed. Flood eyes and affected body parts with water. Transport to hospital.

2. Personal Protection Equipment for Rescue Response
Pressurized full containment chemically inert garment and helmet.
Self contained breathing apparatus. Fluoropolymer gloves & boots.

3. Chain of Authority for Rescue Response
Plant Manager. Department Manager. Department Assistant Manager.
Senior On-Duty Engineer.

4. Other Considerations for Rescue Response
All rescue response to include a minimum of two emergency response personnel, at least one with a wireless communication device. Integrity of wireless communication device(s) and personal protection equipment to be verified prior to rescue response.

III. Security Emergency Response Cleanup Protocol

1. Personal Protection Equipment for Cleanup Response
Pressurized full containment chemically inert garment and helmet. Self contained breathing apparatus. Chemically resistant gloves and boots.

2. Decontamination Procedure for Cleanup Response
Dilute hazardous material with solid or aqueous sodium carbonate to a neutral pH.
Flush with water into a hazardous material drain.

FIG. 2

HAZARDOUS MATERIAL MONITOR/ CONTROL METHOD AND SYSTEM PROVIDING HAZARDOUS MATERIAL RESPONSE AND CONTROL PROCEDURES INTEGRAL THEREWITH

BACKGROUND OF THE INVENTION

1. Field of the Invention

The present invention relates generally to methods, apparatus and systems for monitoring and controlling hazardous materials. More particularly, the present invention relates to methods, apparatus and systems for efficiently monitoring and controlling hazardous materials.

2. Description of the Related Art

Microelectronic fabrications are formed from microelectronic substrates over which are formed patterned microelectronic conductor layers which are separated by microelectronic dielectric layers.

Indigenous within the fabrication of microelectronic fabrications, and particularly within the fabrication of semiconductor integrated circuit microelectronic fabrications, is the use of hazardous materials, including hazardous gaseous material, hazardous liquid materials and hazardous solid materials, but particularly hazardous gaseous materials and hazardous liquid materials. Hazardous materials are indigenous within the art of microelectronic fabrication for use when fabricating microelectronic fabrications insofar as many of the fabrication processes employed for fabricating microelectronic fabrications are typically not readily undertaken employing materials other than hazardous materials.

Since hazardous materials are thus generally unavoidable within the art of microelectronic fabrication for use when fabricating microelectronic fabrications, there thus exists within the art of microelectronic fabrication when fabricating microelectronic fabrications various methods, apparatus and systems for monitoring and controlling hazardous materials when fabricating microelectronic fabrications within microelectronic fabrication facilities.

In turn, while various methods, apparatus and systems for monitoring and controlling hazardous materials when fabricating microelectronic fabrications within microelectronic fabrication facilities are thus clearly desirable, unavoidable and required in the art of microelectronic fabrication for use when fabricating microelectronic fabrications within microelectronic fabrication facilities, such methods, apparatus and systems are nonetheless not entirely without problems within the art of microelectronic fabrication for use when fabricating microelectronic fabrications within microelectronic fabrication facilities. In that regard, while such methods, apparatus and system for monitoring and controlling hazardous materials within the art of microelectronic fabrication when fabricating microelectronic fabrications within microelectronic fabrication facilities are in fact operative for monitoring and controlling hazardous materials within the art of microelectronic fabrication when fabricating microelectronic fabrications within microelectronic fabrication facilities, given a typical plurality of hazardous materials that is typically employed when fabricating microelectronic fabrications within microelectronic fabrication facilities, such methods, apparatus and systems are often not optimized to efficiently provide to emergency response personnel pertinent hazardous material information incident to monitoring, controlling and responding to hazardous material emergencies when fabricating microelectronic fabrications within microelectronic fabrication facilities.

It is thus desirable in the art of microelectronic fabrication to provide methods, apparatus and systems that are optimized to efficiently provide to emergency response personnel pertinent hazardous material information incident to monitoring, controlling and responding to hazardous material emergencies when fabricating microelectronic fabrications within microelectronic fabrication facilities.

It is towards the foregoing object that the present invention is directed.

Various methods, apparatus and systems have been disclosed within arts including but not limited to microelectronic fabrication arts for monitoring, controlling and warning of hazardous materials within the arts including but not limited to microelectronic fabrication arts. Included within the methods, apparatus and systems, but not limited with respect to the methods, apparatus and systems are systems disclosed by: (1) David et al., in U.S. Pat. No. 4,866,594 (a hazardous material monitor and control system that employs various types of modules, serving various hazardous materials monitor functions and various hazardous material control functions, where the various types of modules are positioned within various locations within a fabrication facility, such as a microelectronic fabrication facility, for monitoring and controlling a hazardous material within the fabrication facility, such as the microelectronic fabrication facility); and (2) Fleury et al., in U.S. Pat. No. 5,969,623 (a monitor and warning system for monitoring and warning of a dangerous level of an ambient hazardous carbon monoxide gas or a dangerous level of an ambient hazardous methane gas, as may be encountered incident to malfunction of a heating plant within a residential, commercial or industrial facility, where the monitoring and warning system monitors an ambient carbon monoxide concentration and/or an ambient methane concentration and activates an audible and/or visual alarm incident to achieving a pre-determined threshold value of the ambient carbon monoxide concentration and/or the ambient methane concentration).

Desirable in the art of microelectronic fabrication are additional methods, apparatus and systems that may be optimized to efficiently provide to emergency response personnel pertinent hazardous material information incident to monitoring, controlling and responding to hazardous material emergencies when fabricating microelectronic fabrications within microelectronic fabrication facilities.

It is towards the foregoing object that the present invention is directed.

SUMMARY OF THE INVENTION

A first object of the present invention is to provide a method for monitoring and controlling a hazardous material and a system for monitoring and controlling the hazardous material.

A second object of the present invention is to provide the method for monitoring and controlling the hazardous material and the system for monitoring and controlling the hazardous material in accord with the first object of the present invention, wherein the hazardous material is efficiently monitored and controlled.

A third object of the present invention is to provide the method for monitoring and controlling the hazardous material and the system for monitoring and controlling the hazardous material in accord with the first object of the present invention and the second object of the present invention, wherein the method for monitoring and controlling the hazardous material and the system for monitoring and controlling the hazardous material are readily commercially implemented.

In accord with the objects of the present invention, there is provided by the present invention a method for monitoring and controlling a hazardous material and a system for monitoring and controlling the hazardous material.

The system in accord with the present invention in a first instance comprises a controller. In addition, the system in accord with the present invention in a second instance comprises a hazardous material sensor in communication with the controller. Further, the system in accord with the present invention in a third instance comprises a user interface also in communication with the controller. Finally, within the system in accord with the present invention, the controller is programmed such that when the hazardous material sensor senses a hazardous material, the user interface provides an output directed towards hazardous material response and control procedures for the hazardous material.

The system for monitoring and controlling the hazardous material in accord with the present invention contemplates a method for monitoring and controlling the hazardous material in accord with the present invention while employing the system for monitoring and controlling the hazardous material in accord with the present invention.

The present invention provides a method for monitoring and controlling a hazardous material and a system for monitoring and controlling the hazardous material, wherein the hazardous material is more efficiently monitored and controlled.

The present invention realizes the foregoing object by employing within a method for monitoring and controlling a hazardous material and a system for monitoring and controlling the hazardous material: (1) a controller; (2) a hazardous material sensor in communication with the controller; and (3) a user interface also in communication with the controller, wherein the controller is programmed such that when the hazardous material sensor senses a hazardous material, the user interface provides an output directed towards hazardous material response and control procedures for the hazardous material.

The method for monitoring and controlling the hazardous material and the system for monitoring and controlling the hazardous material are readily commercially implemented.

As will be illustrated in greater detail within the context of the Description of the Preferred Embodiment, as set forth below, the method for monitoring and controlling the hazardous material in accord with the present invention and the system for monitoring and controlling the hazardous material in accord with the present invention may be implemented employing components as are readily available and readily assembled within facilities including but not limited to microelectronic fabrication facilities, but employed within the context of specific operational limitations which provide at least in part the present invention. Since it is thus at least in part a series of operational limitations which provides at least in part the present invention, rather than the existence or fabrication of components which provides the present invention, the method of the present invention is readily commercially implemented and the system of the present invention is readily commercially implemented.

BRIEF DESCRIPTION OF THE DRAWINGS

The objects, features and advantages of the present invention are understood within the context of the Description of the Preferred Embodiment, as set forth below. The Description of the Preferred Embodiment is understood within the context of the accompanying drawings, which form a material part of this disclosure, wherein:

FIG. 2 shows a schematic representation of hazardous material response and control procedures which may be provided employing the hazardous material monitor and control system in accord with the present invention.

DESCRIPTION OF THE PREFERRED EMBODIMENT

Figure 1:
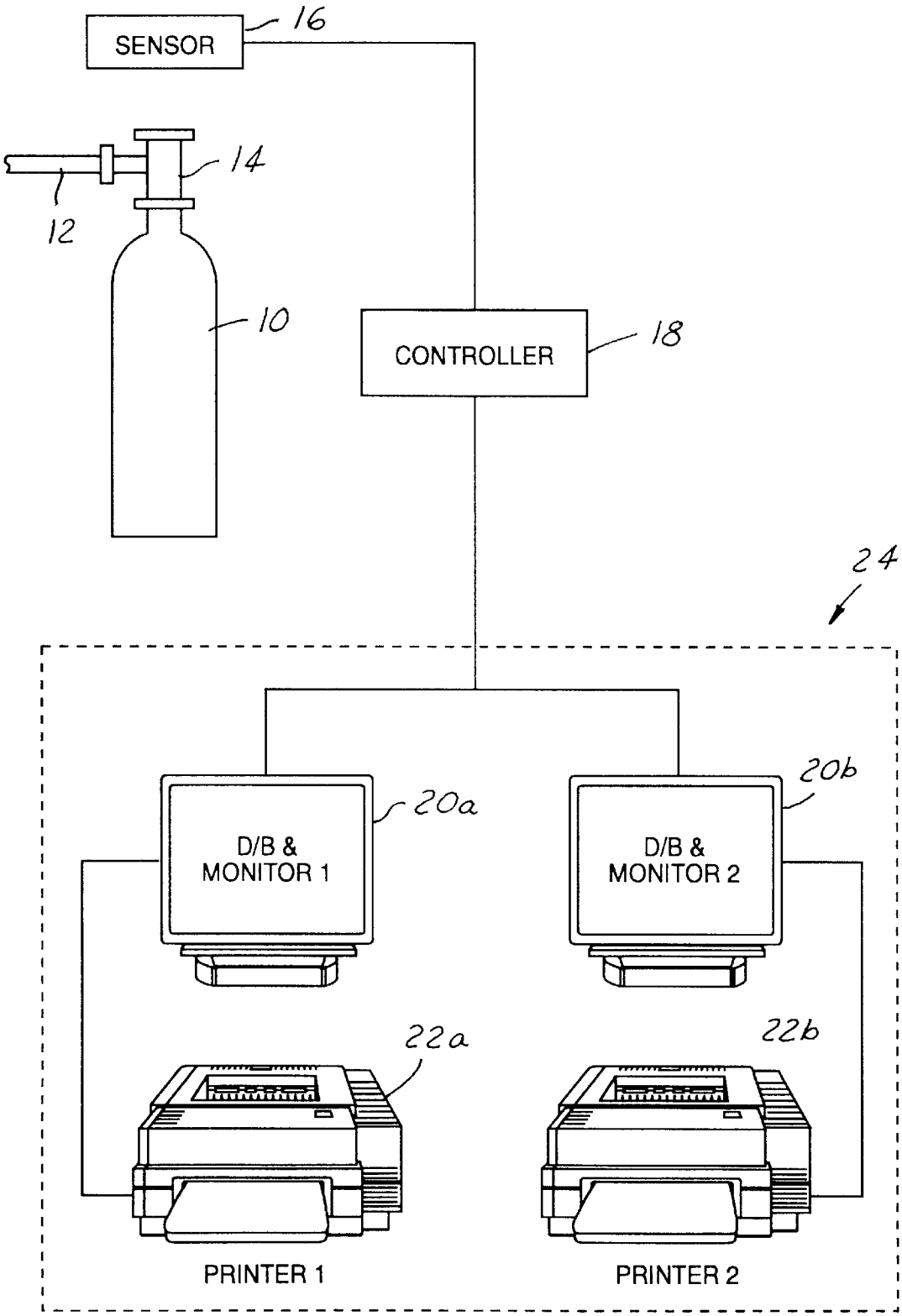
FIG. 1 shows a schematic diagram of a hazardous material monitor and control system in accord with the present invention.

The present invention provides a method for monitoring and controlling a hazardous material and a system for monitoring and controlling the hazardous material, wherein the hazardous material is more efficiently monitored and controlled.

The present invention realizes the foregoing object by employing within a method for monitoring and controlling a hazardous material and a system for monitoring and controlling a hazardous material: (1) a controller; (2) a hazardous material sensor in communication with the controller; and (3) a user interface also in communication with the controller, wherein the controller is programmed such that when the hazardous material sensor senses a hazardous material, the user interface provides an output directed towards hazardous material response and control procedures for the hazardous material.

Although the present invention and the preferred embodiment of the present invention provide particular value within the context of monitoring and controlling a plurality of hazardous materials simultaneously, and in particular hazardous gaseous materials and hazardous liquid materials as employed within a microelectronic fabrication facility, in a first instance the present invention may be employed for monitoring and controlling hazardous materials including but not limited to hazardous gaseous materials, hazardous liquid materials and hazardous solid materials. In addition, in a second instance, the present invention may also be employed for monitoring and controlling hazardous materials within fabrication facilities including but not limited to chemical fabrication facilities, electrical fabrication facilities, electronic fabrication facilities and mechanical fabrication facilities. Finally, in a third instance, when employed for monitoring and controlling hazardous materials within a microelectronic fabrication facility, the present invention may be employed with respect to a microelectronic fabrication facility employed for fabricating microelectronic fabrications including but not limited to integrated circuit microelectronic fabrications, ceramic substrate microelectronic fabrication, solar cell optoelectronic microelectronic fabrications, sensor image array optoelectronic microelectronic fabrications and display image array optoelectronic microelectronic fabrications.

Referring now to FIG. 1, there is shown a schematic diagram of a hazardous material monitor and control system in accord with a preferred embodiment of the present invention.

Shown in FIG. 1 is a hazardous gas cylinder 10 having contained therein a hazardous gas. Within the preferred embodiment of the present invention, the hazardous gas may be selected from any of several hazardous gases as are employed when fabricating microelectronic fabrications. As is further illustrated within the schematic diagram of FIG. 1, the hazardous gas cylinder 10 is connected to a manifold 12 through a valve 14, wherein the manifold supplies the hazardous gas to a microelectronic fabrication facility for purposes of fabricating microelectronic fabrications within the microelectronic fabrication facility. As is understood by a person skilled in the art, the configuration of the hazardous gas cylinder 10, the manifold 12 and the valve 14 as illustrated within the schematic diagram of FIG. 1 is otherwise conventional in the art of microelectronic fabrication.

There is also shown within FIG. 1 within the vicinity of the hazardous gas cylinder 10, and in particular within the vicinity of the valve 14 which controls a flow of the hazardous gas from the hazardous gas cylinder 10, a sensor 16. Within the preferred embodiment of the present invention with respect to the sensor 16, the sensor 16 is otherwise conventional in the art of microelectronic fabrication, but fabricated employing a sensing material which is typically and preferably selectively sensitive with respect to the hazardous gas which is contained within the hazardous gas cylinder 10, in comparison with other hazardous gases or other hazardous materials which may be employed within the microelectronic fabrication facility within which is employed the hazardous gas within the hazardous gas cylinder 10.

Shown also within the schematic diagram of FIG. 1, and connected to the sensor 16, is a controller 18. Similarly, there is further shown within the schematic diagram of FIG. 1, and further connected to the controller 18, a pair of databases and monitors 20*a* and 20*b* having connected thereto a pair of printers 22*a* and 22*b*. As is finally illustrated within the schematic diagram of FIG. 1 the pair of databases and monitors 20*a* and 20*b* having connected thereto the pair of printers 22*a* and 22*b* comprise a user interface 24 within the hazardous material monitor and control system as illustrated within the schematic diagram of FIG. 1.

Within the preferred embodiment of the present invention with respect to the controller 18, the controller 18 is programmed such that when the hazardous gas sensor 16 senses the hazardous gas, and in particular a hazardous gas leak from the hazardous gas cylinder 10 within the vicinity of the valve 14 which supplies the manifold 12, there is provided within the user interface 24 an output directed towards hazardous material response and control procedures for the hazardous gas within the hazardous gas cylinder 10.

Within the preferred embodiment of the present invention with respect to the pair of databases and monitors 20*a* and 20*b* having connected thereto the pair of printers 22*a* and 22*b*, one of the pair of databases and monitors 20*a* and 20*b* having connected thereto the pair of printers 22*a* and 22*b* will typically and preferably be dedicated to a hazardous gas system monitor and control display, and the other of the pair of databases and monitors 20*a* and 20*b* having connected thereto the pair of printers 22*a* and 22*b* will typically and preferably provide the output directed towards the hazardous gas response and control procedures for the hazardous gas contained within the hazardous gas cylinder 10.

As is further understood by a person skilled in the art, the output directed towards the hazardous gas response and control procedures for the hazardous gas contained within the hazardous cylinder 10 may be provided by the hazardous material monitor and control system as illustrated within the schematic diagram of FIG. 1 as either of, or both of, a visual output and a printed output.

As is yet further understood by a person skilled in the art, although the preferred embodiment of the hazardous material response and control system of the present invention as illustrated within the schematic diagram of FIG. 1 illustrates the hazardous material response and control system of the present invention within the context of the controller 18 which is external to the user interface 24, within the present invention and the preferred embodiment of the present invention a controller, such as the controller 18, may also be incorporated into and integral with any of various components which comprise a user interface, such as the user interface 24.

As is still yet further understood by a person skilled in the art, although the preferred embodiment of the present invention illustrates the present invention within the context of the sensor 16, the controller 18 and the pair of databases and monitors 20*a* and 20*b* having connected thereto the corresponding pair of printers 22*a* and 22*b*, where all of the foregoing group of components are presumably integrally hard wired, all of the foregoing group of components need only communicate in the fashion as described above and may do so employing hard wiring techniques and methods, wireless techniques and methods and hybrid techniques and methods thereof.

Finally, as is also still yet further understood by a person skilled in the art, although the preferred embodiment of the present invention illustrates the controller 18 as a nominal hardware component intermediate with respect to only the sensor 16 and the pair of databases and monitors 20*a* and 20*b* having connected thereto the pair of printers 22*a* and 22*b*, the controller 18 may also control other illustrated, unillustrated, conventional and unconventional components, to thus provide additional functions within the hazardous material monitor and control system whose schematic diagram is illustrated in FIG. 1. Such additional functions may include, but are not limited to, control functions with respect to remote shut off of the valve 14, as well as alarm functions within various locations within the microelectronic fabrication facility within which is installed the hazardous material monitor and control system. Similarly, the controller may comprise a hardware based controller, a software based controller or a hybrid hardware/software based controller.

Referring now to FIG. 2, there is shown a schematic representation illustrating an exemplary output of hazardous material response and control procedure which may be provided in conjunction with operation of the hazardous material response and control system of the present invention.

Shown in FIG. 2 is a hazardous material response and control procedure most specifically directed towards hydrogen bromide, although hazardous material response and control procedures directed towards other materials may clearly also be employed and provided within the context of the present invention.

As is illustrated within the schematic representation of FIG. 2, the hazardous material response and control procedure comprises a first section directed towards hazardous material properties, a second section directed towards a primary emergency response rescue protocol and a third section directed towards a secondary emergency response cleanup protocol. The contents of each of the sections is readily understood by a person skilled in the art.

As is understood by a person skilled in the art, by providing within the context of the present invention a hazardous material response and control procedure incident to the earliest sensing of a release of a particular hazardous material, a hazard response party may be more efficiently and timely prepared in responding to a hazardous material emergency.

As is understood by a person skilled in the art, the preferred embodiment of the present invention is illustrative of the present invention rather than limiting of the present invention. Revisions and modifications may be made to materials and procedures as are disclosed within the preferred embodiment of the present invention while still providing a method in accord with the present invention and a system in accord with the present invention, further in accord with the accompanying claims.

What is claimed is:

1. A system for monitoring and controlling a hazardous material comprising:

a controller;

a hazardous material sensor in communication with the controller; and a user interface in communication with the controller, wherein the controller is programmed such that when the hazardous material sensor senses a hazardous material, the user interface provides an output directed towards hazardous materials response and control procedures for the hazardous material.

2. The system of claim 1 wherein the controller is selected from the group consisting of hardware based controllers, software based controllers and hybrid hardware/software based controllers.

3. The system of claim 1 wherein the hazardous material is selected from the group consisting of hazardous gaseous materials, hazardous liquid materials and hazardous solid materials.

4. The system of claim 1 wherein the user interface is selected from the group consisting of a monitor and a printer.

5. A fabrication facility having assembled therein the system in accord with claim 1.

6. The fabrication facility of claim 5 wherein the fabrication facility is selected from the group consisting of chemical fabrication facilities, electrical fabrication facilities, electronic fabrication facilities and mechanical fabrication facilities.

7. The fabrication facility of claim 5 wherein the fabrication facility is a microelectronic fabrication facility selected from the group consisting of integrated circuit microelectronic fabrication facilities, ceramic substrate microelectronic fabrication facilities, solar cell optoelectronic microelectronic fabrication facilities, and display image array optoelectronic microelectronic fabrication facilities.

8. A method for monitoring and controlling a hazardous material comprising:

providing a system for monitoring and controlling a hazardous material, the system comprising:

a controller;

a hazardous material sensor in communication with the controller and in the vicinity of a hazardous materials source; and a user interface in communication with the controller, wherein the controller is programmed such that when the hazardous material sensor senses a hazardous material, the user interface provides an output directed towards hazardous material response and control procedures for the hazardous material;

effecting a release of a hazardous material from the hazardous material source; and obtaining from the user interface the output directed towards hazardous material response and control procedures for the hazardous material.

9. The method of claim 8 wherein the controller is selected from the group consisting of hardware based controllers, software based controllers and hybrid hardware/software based controllers.

10. The method of claim 8 wherein the hazardous material is selected from the group consisting of hazardous gaseous materials, hazardous liquid materials and hazardous solid materials.

11. The method of claim 8 wherein the user interface is selected from the group consisting of a monitor and a printer.

12. The method of claim 8 wherein the hazardous material source is contained within a fabrication facility.

13. The method of claim 12 wherein the fabrication facility is selected from the group consisting of chemical fabrication facilities, electrical fabrication facilities, electronic fabrication facilities and mechanical fabrication facilities.

14. The method of claim 12 wherein the fabrication facility is a microelectronic fabrication facility selected from the group consisting of integrated circuit microelectronic fabrication facilities, ceramic substrate microelectronic fabrication facilities, solar cell optoelectronic microelectronic fabrication facilities, and display image array optoelectronic microelectronic fabrication facilities.

* * * * *